United States Patent [19]

Aysta

[11] 4,009,922

[45] Mar. 1, 1977

[54] CONNECTOR

[75] Inventor: James E. Aysta, Stillwater, Minn.

[73] Assignee: Minnesota Mining and Manufacturing Company, St. Paul, Minn.

[22] Filed: Nov. 10, 1975

[21] Appl. No.: 630,220

[52] U.S. Cl. ..... 339/99 R

[51] Int. Cl.[2] ..... H01R 9/08

[58] Field of Search ..... 339/97–99, 339/103, 107, 206, 207, 208, 210

[56] References Cited

UNITED STATES PATENTS

| | | | |
|---|---|---|---|
| 3,760,335 | 9/1973 | Roberts | 339/99 R |
| 3,820,058 | 6/1974 | Friend | 339/99 R |
| 3,858,159 | 12/1974 | Worth | 339/99 R |

*Primary Examiner*—Joseph H. McGlynn
*Attorney, Agent, or Firm*—Cruzan Alexander; Donald M. Sell; Terryl K. Qualey

[57] ABSTRACT

A connector having an insulating body formed with a plurality of parallel wire support channels, each of the channels being formed with a transverse step defining upper and lower wire support levels. The adjacent channels are formed with steps rising in opposite directions to position a lower wire support level between two upper wire support levels. A bifurcate spring compression reserve contact element extends through an aperture in each of the lower wire support levels and a cover formed with channels complementary to those on the body is retained on the body to support, retain and make electrical connection to wires in the channels.

3 Claims, 5 Drawing Figures

CONNECTOR

FIELD OF THE INVENTION

The present invention relates to a connector for making electrical connection to a plurality of insulated wires.

BACKGROUND OF THE INVENTION

Telephone wires are generally of 24 or 26 gauge AWG wire and are provided in pairs, one of the wires in the pair being the tip wire and the other being the ring wire. In the United States of America, for example, telephone cables are provided with 25 pairs of wires or multiples thereof. Telephone wire connectors designed for use in the United States of America are, therefore, generally made to connect 25 pairs of wires.

One standard type of telephone cable connector comprises a female connector and a mating male connector. The female connector is formed on one surface with a recess having generally vertical interior side walls along which wiping contacts are arranged, the contacts being exposed on the opposite surface for making connection to the wires of a cable. The male connector is formed on one surface with a central rib having generally vertical sidewalls along which wiping contacts are arranged complementary to the wiping contacts on the female connector. The contacts on the male connector also extend through the opposite surface of the male connector for connection to the wires of the cable. Such connectors are, for example disclosed in U.S. Pat. Nos. 3,277,426; 3,599,172; 3,657,682 and 3,760,335. Until now, the construction of such connectors has required that they be wired in two parallel rows generally perpendicular to the wiring surfaces of each of the male and female connector, making it extremely difficult to wire such connectors in series where multiple connections to a single cable are desired. Further, such connectors have required that separate strain relief be provided to prevent strain on the wire from being transferred to the contact element and degrading the connection.

Telephone cable connectors having wire stripping contact elements in parallel channels have previously been taught, for example in U.S. Pat. No. 3,708,779, and they are in widespread use because of their greater ease of application. However, the wire spacing in the standard male-female telephone cable connector is too close to permit the use of the cable connector of U.S. Pat. No. 3,708,779 due to the interference of the contact element with the wires on either side of the one it is connecting. The contact elements cannot simply be made narrower since they become too weak to make effective spring compression reserve contact with the wires.

SUMMARY OF THE INVENTION

The present invention provides a connector having an insulating body formed on one surface with a plurality of parallel wire support channels, each of the channels being formed with a transverse step defining upper and lower wire support levels. The adjacent channels are formed with steps rising from generally coplanar lower wire support levels to generally coplanar upper wire support levels in opposite directions lengthwise of the channels to position a lower wire support level between two upper wire support levels. The body is formed with an aperture therethrough extending across the lower wire support level of each channel. A plurality of spring compression reserve contact elements are carried by the body, each contact having a bifurcate insulation stripping and conductor connecting end. The bifurcate contact connecting end of a contact element extends through an aperture in the body to make electrical connection to a wire supported on the lower wire support level and it terminates below the adjoining upper wire support levels with the outer edges of the legs thereof abutting the adjoining upper support levels of the body. A cover is formed on one surface with parallel stepped wire support channels complementary to the channels on the base and means are provided for retaining the cover on the base with the complementary channels aligned to support, retain and make electrical connection to wires in the channels.

The upper wire support levels raise the wires adjacent the contact element above the contact element to prevent their interference. The walls of the upper wire support levels bounding a lower support level back up the legs of the spring compression reserve contact element in the lower support level increasing the effectiveness of the electrical connection it makes thereby permitting use of narrower contact elements than can be used when they are free standing. Both the raising of the wires on the upper support levels and the use of narrower contact elements which are backed by the sidewalls of the upper support levels permits closer wire spacing so that the wire spacing in the standard female-male telephone wire connector can be used. Furthermore, the use of the complementary stepped body and cover provides the necessary strain relief.

THE DRAWING

Figure 1:
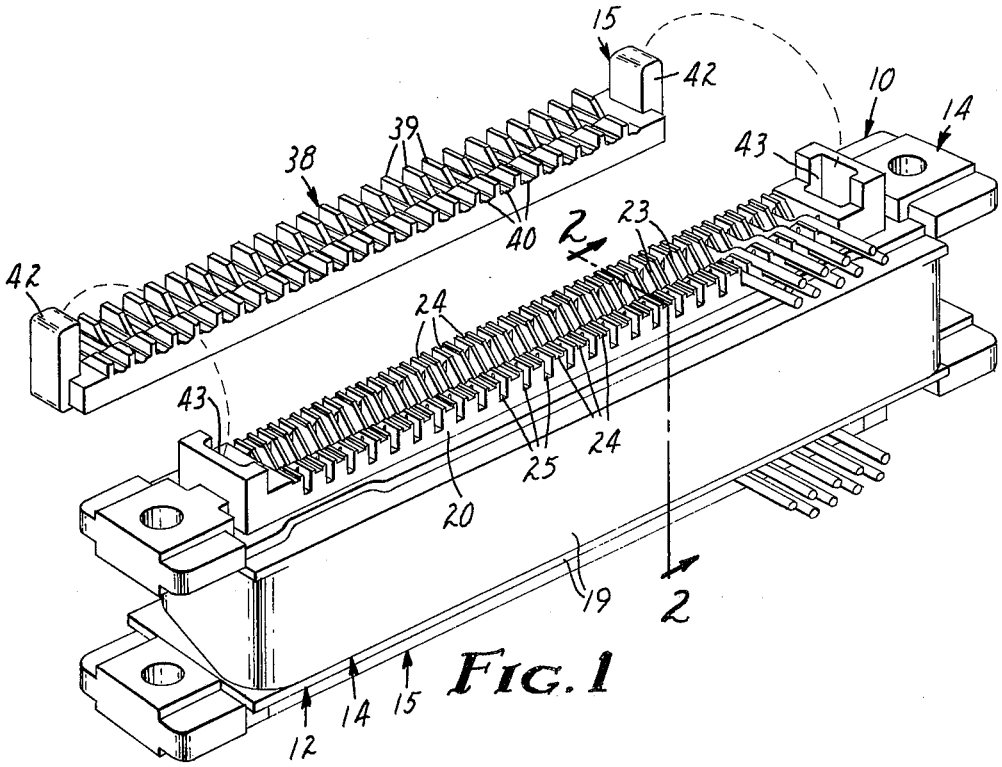
FIG. 1 is a longitudinal perspective view of a male connector and a female connector made in accordance with the present invention and shown in normal use except that the cover of the male connector is removed to show the complementary surfaces of the body and cover thereof.

The illustrated male connector 10 and female connector 12 are constructed in accordance with the present invention. Each comprises a body 14, a cover 15 and contact elements 16.

Each of the male and female bodies 14 are constructed of three parts for ease in molding and assembly. Each body 14 consists of a cap 18, a body bottom 19 and a body top 20.

Both the male and female bodies 14 are formed on their upper surfaces with a plurality of parallel wire support channels 22. The wire support channels 22 on the female body 14 are a mirror image of those on the male body 14 illustrated in FIG. 1. Each of the wire support channels 22 is formed with a transverse step 23 defining upper and lower wire support levels 24 and 25, respectively. Adjacent channels are formed with steps 23 rising from generally coplanar lower wire support levels 25 to generally coplanar upper wire support levels 24 in opposite directions lengthwise of the channels 22 to position a lower wire support level 25 between two upper support levels 24.

The bodies 14 are formed with a contact element aperture 27 therethrough extending across the lower wire support level 25 of each channel 22.

Figure 3:
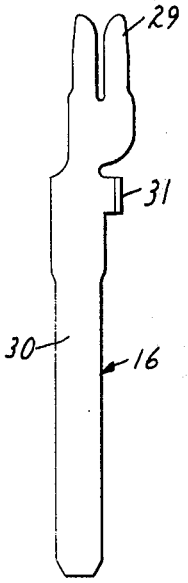
FIG. 3 is a front elevation view of a spring compression reserve contact element used in both the male and female connectors.
Figure 2:
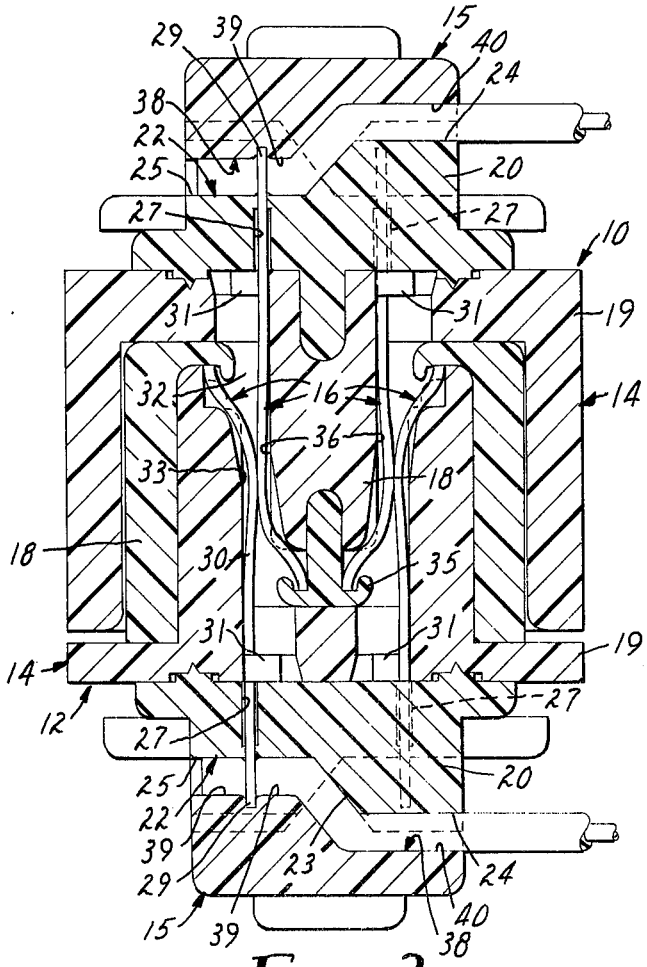
FIG. 2 is a cross-sectional view taken generally along line 2—2 of FIG. 1.
Figure 5:
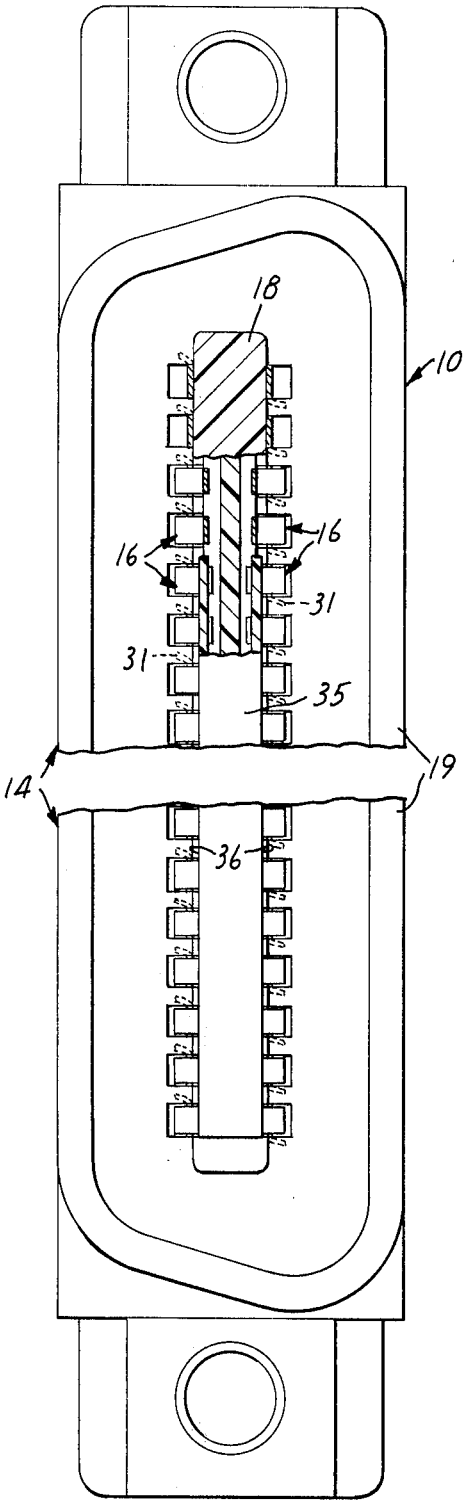
FIG. 5 is a similar longitudinal view of the mating surface of the male connector.
Figure 4:
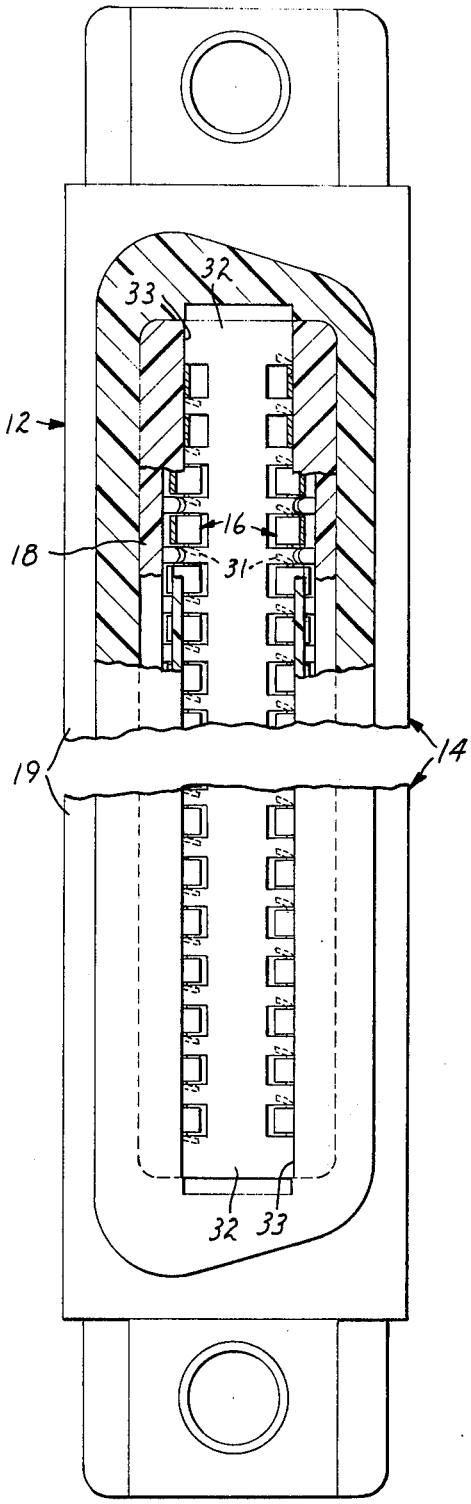
FIG. 4 is a longitudinal view of the mating surface of the female connector.

A plurality of the spring compression reserve contact elements 16 are carried by each of the male and female connector bodies 14. The contact elements 16 of the male connector 10 and the female connector 12 are identical and one of them is illustrated in FIG. 3. Each contact element 16 has a bifurcate insulation stripping and conductor connecting end 29 which extends through an aperture 27 in a connector body to make electrical connection to a wire supported on a lower wire support level 25. The bifurcate end 29 of the contact element terminates below the adjoining upper wire support levels 24 with the outer edges of the legs thereof abutting the adjoining upper support levels 24 of the connector body. Each contact element also includes an elongate contact body 30 supported by the connector body with a portion of one face exposed for making wiping contact with a similar contact element carried by the outer connector body. The bifurcate spring compression reserve contact end 29 is connected to the contact body 30 coplanar with the adjoining portion thereof, parallel to the contact body 30. The bifurcate contact end 29 is offset from the contact body such that the centerline of the bifurcate contact end 29 and of the slot therein are spaced from the centerline of the contact body 30 a distance equal to one-half of the spacing between adjacent wire support channels 22. A retaining tab 31 is formed perpendicular to the contact body and is captured in a recess in the male or female body portion 19 to prevent longitudinal movement of the contact element 16 with respect to the connector body 14.

The female connector body 14 is formed on the surface opposite the wire channel surface with a central, generally rectangular recess 32 with generally vertical interior sidewalls 33, the wiping contact portions of the contact element bodies 30 being exposed along the interior side walls 33. The male body 14 is formed on the surface opposite its wire channel surface with a central, generally rectangular rib 35 complementary to the female recess 32 and having generally vertical exterior side walls 36 along which the wiping contact portions of the contact element bodies 30 are exposed. The one-half channel offset of the bifurcate contact end 29 from the contact body 30 puts the contact body of a contact element carried by the female connector 12 in position to make wiping contact with the contact body of the proper contact element carried by the male connector 10 to connect the corresponding wires in the cable.

The male and female covers 15 are formed on one surface with parallel stepped wire support channels 38 complementary to the channels 22 on the male and female bodies 14, respectively. Upper wire support levels 39 on the covers 15 fit into the lower wire support levels 25 of the bodies 14 to press a wire in the wire support channel 22 into the bifurcate end 29 of the contact element 16. The upper wire support levels 24 of the bodies 14 fit into the lower wire support levels 40 of the covers 15 to firmly engage and retain the insulation covered wire, thereby to provide strain relief. The covers 15 are provided at their ends with posts 42 which press fit into slots 43 in the bodies 14 to retain the covers 15 on the bodies 14 with the complementary channels 22 and 38 aligned to support, retain and make electrical connection wires in the channels.

In one illustrative example male and female connectors 10 and 12 were each constructed with overall lengths of 8.4 centimeters (3.3 inches) and an overall height of 1.8 centimeters (0.7 inch). The wire support channels 22 and 38 were spaced 0.108 centimeters (0.0425 inch) on centers and the bifurcate ends 29 of the contact elements 16 were 0.127 centimeter (0.050 inch) wide. The contact elements were formed of a copper alloy and were inlaid with gold along the portion of the contact body 30 designed to make wiping contact with the elements carried by the opposite connector body.

I claim:

1. A connector comprising:

an insulating body formed on one surface with a plurality of parallel wire support channels, each of said channels being formed with a transverse step defining upper and lower wire support levels, adjacent channels being formed with steps rising from generally coplanar lower wire support levels to generally coplanar upper wire support levels in opposite directions lengthwise of said channels to position a lower wire support level between two upper wire support levels, said body being formed with a plurality of apertures therethrough, one aperture extending across the lower wire support level of each said channel, a plurality of spring compression reserve contact elements carried by said body, each contact having a bifurcate insulation stripping and conductor connecting end, a bifurcate contact connecting end of a contact element extending through each said aperture in said body to make electrical connection to a wire supported on a said lower wire support level and terminating below the adjoining upper wire support levels with the outer edges of the legs thereof abutting the adjoining upper support levels of said body, a cover formed on one surface with parallel stepped wire support channels complementary to said channels on said body, and means for retaining said cover on said body with said complementary channels aligned and the wires in the bifurcations of said contact elements to support and retain the wires in said channels and to make electrical connection between said contact elements and the wires.

2. The connector of claim 1 wherein said insulating body is formed on the surface opposite said wire channel surface as a female connector with a central generally rectangular recess with generally vertical interior side walls, and wherein each said contact element is formed with an elongate contact body supported by said connector body with a portion of one face exposed along said connector body sidewalls for making wiping contact with a similar contact element carried by a complementary male connector.

3. The connector of claim 1 wherein said insulating body is formed on the surface opposite said wire channel surface as a male connector with a central generally rectangular rib with generally vertical exterior sidewalls, and wherein each said contact element is formed with an elongate contact body supported by said connector body with a portion of one face exposed along said connector body sidewalls for making wiping contact with a similar contact element carried by a complementary female connector.

* * * * *